US005554435A

United States Patent [19]

Gupta et al.

[11] Patent Number: 5,554,435

[45] Date of Patent: Sep. 10, 1996

[54] TEXTILE STRUCTURES, AND THEIR PREPARATION

[75] Inventors: Rakesh K. Gupta, Rockdale County; Richard J. Legare, Newton County, both of Ga.

[73] Assignee: Hercules Incorporated, Wilmington, Del.

[21] Appl. No.: 210,989

[22] Filed: Mar. 18, 1994

Related U.S. Application Data

[63] Continuation-in-part of Ser. No. 189,233, Jan. 31, 1994, abandoned.

[51] Int. Cl.[6] ..... B32B 5/08; B32B 5/26; D04H 3/14; D04H 3/16

[52] U.S. Cl. ..... 428/224; 156/62.6; 156/62.8; 156/308.2; 428/286; 428/287; 428/288; 428/296; 428/302

[58] Field of Search ..... 428/286, 287, 428/288, 296, 302, 224; 156/62.6, 62.8, 308.2

[56] References Cited

U.S. PATENT DOCUMENTS

| | | | |
|---|---|---|---|
| 3,595,245 | 7/1971 | Buntin et al. . | |
| 3,676,242 | 7/1972 | Prentice . | |
| 3,704,198 | 11/1972 | Prentice . | |
| 3,715,251 | 2/1973 | Prentice . | |
| 3,837,995 | 9/1974 | Floden . | |
| 3,849,241 | 11/1974 | Buntin et al. . | |
| 3,978,185 | 8/1976 | Buntin et al. . | |
| 4,041,203 | 8/1977 | Brock et al. . | |
| 4,196,245 | 4/1980 | Kitson et al. . | |
| 4,436,780 | 3/1984 | Hotchkiss et al. . | |
| 4,508,113 | 4/1985 | Malaney . | |
| 4,537,822 | 8/1985 | Nanri et al. . | |
| 4,555,811 | 12/1985 | Shimalla . | |
| 4,753,843 | 6/1988 | Cook et al. . | |
| 4,766,029 | 8/1988 | Brock et al. . | |
| 4,818,597 | 4/1989 | Daponte et al. . | |
| 4,863,785 | 9/1989 | Berman et al. . | |
| 4,906,513 | 3/1990 | Kebbell et al. . | |
| 5,108,827 | 4/1992 | Gessner . | |
| 5,114,787 | 5/1992 | Chaplin et al. . | |
| 5,173,356 | 12/1992 | Eaton et al. . | |
| 5,229,191 | 7/1993 | Austin . | |
| 5,236,771 | 8/1993 | Groshens . | |
| 5,281,378 | 1/1994 | Kozulla . | |
| 5,318,735 | 6/1994 | Kozulla | 264/171 |
| 5,431,994 | 7/1995 | Kozulla | 428/286 |

FOREIGN PATENT DOCUMENTS

| | | |
|---|---|---|
| 0279511 | 8/1988 | European Pat. Off. . |
| 0445536 | 9/1991 | European Pat. Off. . |
| 0552995 | 1/1993 | European Pat. Off. . |
| 1217892 | 9/1973 | United Kingdom . |
| 9306169 | 4/1993 | WIPO . |

OTHER PUBLICATIONS

WENTE, "Superfine Thermoplastic Fibers", *Industrial & Engineering Chemistry*, vol. 48, No. 8 (1956), pp. 1342–1346.

Trent et al., "Ruthenium Tetroxide Staining of Polymer for Electron Microscopy", *Macromolecules*, 16(4), 1983.

ASTM D 12381–82, Condition FR–230/2.16.

ASTM D2857–70 (Reapproved 1977).

Inda Standard Test Method 1st 110.1–92 G–T test.

Inda Standard Test Method 1st 70.1–92 test.

Inda Standard Test Method 1st 80.4–92 test.

*Primary Examiner*—James C. Cannon

*Attorney, Agent, or Firm*—Mark D. Kuller

[57] ABSTRACT

Nonwoven structures, prepared from meltblown microfibers, and fibers having heterogeneous melt viscosity. The structures can be in the form of composite nonwoven fabrics, made from alternating layers of the indicated meltblown and heterogeneous fibers; the melt flow rate, of the surface of the heterogeneous fibers, can be one third or more of the meltblown fibers' melt flow rate. The composite nonwoven fabrics have excellent barrier properties, and are useful as sterilization wraps, and for other medical, industrial, and hygiene applications.

37 Claims, 4 Drawing Sheets

TEXTILE STRUCTURES, AND THEIR PREPARATION

BACKGROUND OF THE INVENTION

1. Continuing Application Data

This application is a continuation-in-part of U.S. application Ser. No. 08/189,233, filed Jan. 31, 1994, and now abandoned, which is incorporated herein in its entirety, by reference thereto.

2. Field of the Invention

The present invention relates to textile structures—particularly nonwoven composite structures—and their preparation.

3. Description of Background and Other Information

Composite nonwoven fabrics, prepared from meltblown microfiber layers and layers of other fibers, are known in the art. U.S. Pat. No. 3,837,995 discloses multiple ply webs which include one or more layers each of microfibers and natural fibers. U.S. Pat. No. 4,041,203 discloses nonwoven fabrics, prepared from integrated mats of microfibers and webs of spunbonded continuous filaments.

U.S. Pat. No. 4,863,785 discloses a nonwoven composite material, comprising a meltblown microfiber thermoplastic layer sandwiched between two prebonded reinforcing fabric layers; these reinforcing layers are of thermoplastic polymeric filaments, and are selected from spunbonded, wetlaid, and carded webs. The indicated composite material is disclosed as being suitable for such articles as sterilization wraps and garments, with medical and industrial applications.

However, in prior art fabrics there has been limited thermal bondability between meltblown microfibers, which are typically prepared from low melt viscosity polymers, and such other fibers. Accordingly, where the meltblown microfibers have been thusly used with other fibers in composite configurations, nonwoven scrims have also been required—for the purpose of tying down the microfibers sufficiently, to provide the lint free fabrics needed for medical applications. Such fabrics are disclosed in U.S. Pat. Nos. 4,436,780, 4,537,822, 4,753,843, 4,766,029, 4,818,597, 5,236,771, and 5,229,191.

U.S. Pat. Nos. 4,508,113 and 4,555,811 disclose surgical drapes comprising a meltblown microfine fiber layer bonded to a conjugate fiber layer; the conjugate fibers can be bicomponent fibers, and comprise higher and lower melting components. The melt temperature of the lower melting component of the conjugate fibers is indicated preferably to substantially match the melt temperature of the meltblown microfiber layer to which they are bonded, and it is further indicated that the lower melting component of the conjugate fibers preferably comprises the same material as is used for the indicated meltblown microfiber layer; this relationship of melt temperature and material is stated to result in a far stronger and more intimate bond.

It has been discovered that textile structures, particularly nonwoven structures, can be prepared from meltblown microfibers and fibers which have heterogeneous melt viscosity, and which are prepared from a single polymer or polymer alloy, and which have a constant melting point across their cross-sections. It has further been discovered that such textile structures can be prepared from meltblown microfibers and fibers which have heterogeneous melt viscosity, and which are characterized by surfaces having a melt flow rate at least one third or about one third the melt flow rate of the meltblown microfibers.

These nonwoven structures—particularly the composite fabrics, comprising one or more layers of the meltblown microfibers, and one or more layers of heterogeneous melt viscosity fibers as specified—are characterized by excellent barrier properties.

SUMMARY OF THE INVENTION

The invention pertains to a nonwoven structure comprising first fibers and second fibers, the first fibers comprising meltblown microfibers, and the second fibers preferably being selected from one of two embodiments. In the first of these embodiments, the second fibers consist essentially of a single polymer or polymer alloy, and have a nonuniform melt viscosity and a substantially constant melting point across their cross-sections; in the second embodiment, the second fibers have nonuniform melt viscosity across their cross-sections, and have surfaces characterized by a melt flow rate which is at least about one third of the melt flow rate of the first fibers.

Preferably, the first and second fibers are thermoplastic fibers. As a matter of particular preference, the thermoplastic first and second fibers comprise polypropylene.

The nonwoven structure can be a composite nonwoven structure, comprising at least one layer of the first fibers and at least one layer of the second fibers. Preferably, the at least one layer of the first fibers, and the at least one layer of the second fibers, are positioned in alternating surface to surface relationship.

The invention also pertains to a method of preparing the indicated composite nonwoven structure, comprising a bonding step, of thermally bonding the at least one layer of first fibers and the at least one layer of second fibers. Where the second fibers are in the form of carded staple fibers, the method of the invention may include, prior to the bonding step, a preliminary bonding step which comprises thermally bonding the carded staple fibers, to obtain the at least one layer of second fibers; where the second fibers comprise spunbonded continuous filaments, the method of the invention may include, prior to the bonding step, a preliminary step of preparing the at least one layer of second fibers, from the indicated spunbonded continuous filaments.

DESCRIPTION OF THE INVENTION

Figure 1:
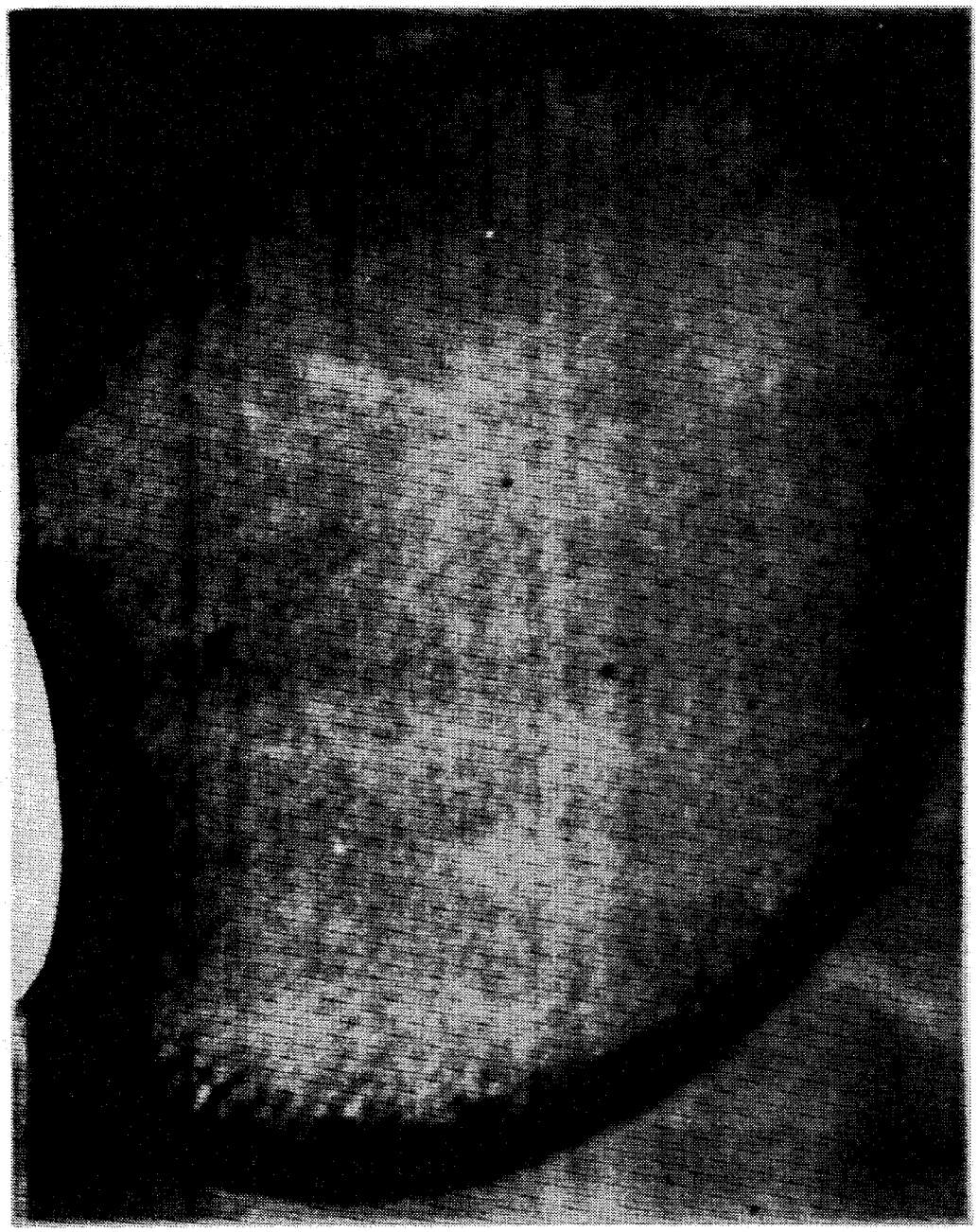
FIGS. 1 and 2 are transmission electron photomicrographs of cross-sections of fibers of the invention, at about 5000× magnification. These fibers have heterogeneous melt viscosity, and are stained by the $RuO_4$ staining technique.

The textile structures of the invention include nonwoven structures or fabrics, and comprise meltblown microfibers, and fibers having differential cross-sectional melt viscosity profile—i.e., having nonuniform viscosity across their cross-sections. These are also referred to herein as the first fibers and the second fibers, respectively.

Polymers suitable for the indicated first and second fibers include the thermoplastic polymers. The thermoplastic polymers generally are appropriate, and particular such polymers which may be employed include the following: polycarbonates; polyesters, such as poly(oxyethyleneoxyterephthaloyl); polyamides, such as poly(imino-1-oxohexamethylene) (Nylon 6), hexamethylenediaminesebacic acid (Nylon 6-10), and polyiminohexamethyleneiminoadipoyl(Nylon 6,6); polybutylene terephthalate; polyethylene terephthalate; polyoxymethylenes; polystyrenes; styrene copolymers, such as styrene acrylonitrile (SAN); polyphenylene ethers; polyphenylene oxides (PPO); polyetheretherketones (PEEK); polyetherimides; polyphenylene sulfides (PPS); polyvinyl acetates (PVA); polymethyl methacrylates (PMMA); polymethacrylates (PMA); ethylene acrylic acid copolymers; and polysulfones.

Preferred polymers for the fibers of the invention are the polyolefins. Among those polyolefins which may be used are homopolymers and copolymers; in this context, the copolymers are understood as including both those polymers incorporating two different monomeric units, as well as polymers incorporating three or more different monomeric units, e.g., terpolymers, etc.

It is further understood that reference to a polymer of any particular monomeric unit—e.g., reference to a particular polyolefin—encompasses the presence of one or more yet additional components, in addition to the named monomer; for example, polypropylene can include up to about 10 weight percent of one or more other monomeric units—particularly olefin units—such as ethylene, butene, etc. It is yet additionally understood that reference to a particular polymer also encompasses an alloy of this polymer with up to about 20 percent by weight of one or more additional polymers or other materials.

Whether any such additional material is indeed present, and the amounts of such additional material which are employed, can be a matter of intentional design, for achieving a specified purpose or purposes—e.g., one or more desired properties of the ultimately obtained fiber or filament. Further, the presence and amounts of such additional material can be because of different circumstances—e.g., the purity of what is available for use.

Among the olefin monomers suitable, for the polyolefins of the invention, are propylene, ethylene, 1-butene, 2-butene, isobutylene, pentene, hexene, heptene, octene, 2-methylpropene-1, 3-methylbutene-1, 4-methylpentene- 1, 4-methylhexene-1, 5-methylhexene-1, bicyclo-(2,2,1)-2-heptene, butadiene, pentadiene, hexadiene, isoprene, 2,3-dimethylbutadiene- 1,3, 1-methylpentadiene-1, 3,4-vinylcyclohexene, vinylcyclohexene, cyclopentadiene, styrene, and methylstyrene. Consistent with the foregoing, the polyolefins of the invention include the homopolymers, and copolymer combinations, of the indicated olefin monomers, which are suitable for the fibers of the invention.

Particular appropriate polyolefins are those polypropylenes (PP), including the atactic, syndiotactic, and isotactic polypropylenes, and polyethylenes (PE), including the low density polyethylenes (LDPE), high density polyethylenes (HDPE), and linear low density polyethylenes (LLDPE), which are thusly suitable. Further appropriate polyolefins, among the copolymers, are those ethylenepropylene copolymers, including block copolymers of ethylene and propylene, and random copolymers of ethylene and propylene, which are likewise appropriate for the fibers of the invention.

For the first and/or the second fibers of the invention, two or more polymers may be employed, in whatever relative amounts are suitable for obtaining a product characterized by the properties desired for a particular purpose. In this regard, polymer alloys and polymer combinations, including alloys and combinations of two or more of the polymers as identified herein, are suitable for the first and/or second fibers of the invention. The types and proportions of the polymers used can be readily determined by those of ordinary skill in the art, without undue experimentation.

Particularly, a single polyolefin, or two or more polyolefins, may be employed. Additionally, one or more other polymers can be employed, together with the one or more polyolefins. In such instance, the fibers are still understood, and are thusly considered, as being polyolefin fibers, notwithstanding the presence of one or more such other polymers. A suitable example, of the indicated other polymers, is polyester.

Consistent with the foregoing, polyethylene/polypropylene alloys, and polyethylene/polyester combinations, are suitable for the first and/or the second fibers of the invention.

The indicated meltblown microfibers of the invention can be prepared by known techniques, such as set forth in "Superfine Thermoplastic Fibers", *Industrial & Engineering Chemistry*, Vol. 48, No. 8 (1956), pp. 1342–1346, and in U.S. Pat. Nos. 5,173,356, 4,863,785, 4,041,203, 3,978,185, 3,849,241, 3,715,251, 3,704,198, 3,676,242, 3,595,245, and British Specification No. 1,217,892—these publications and patent documents being incorporated herein in their entireties, by reference thereto. In the meltblowing treatment, extruded polymer melt is stretched, broken into short fibers, blown by a jet of heated gas—typically, an air stream—and deposited on a belt to form the nonwoven structure. The process includes extruding a fiber-forming thermoplastic polymer, in molten form, through orifices of a heated nozzle, into the stream of hot gas; the molten polymer is thereby formed into a stream of discontinuous and attenuated fibers. The fibers are collected on a receiver in the path of the fiber stream to form a nonwoven mat or web. The nonwoven mat or web can be used in this form; optionally, an additional step of bonding of the mat or web to provide added integrity and strength can be conducted as a separate downstream operation.

The meltblown microfibers thusly obtained generally have an average length of less than about 2 centimeters and an average diameter of about 5 microns or less—preferably, the average diameter is about 2–5 microns. Commercially available meltblown microfiber webs, suitable for the invention, include those from Ergon Nonwovens, Inc., Jackson, Miss., such as the polypropylene meltblown microfiber webs from this source.

The indicated second fibers of the invention exhibit heterogeneous melt viscosity—i.e., as discussed, are characterized by nonuniform, or varying, melt viscosity across their cross-sections. Correspondingly, they are also referred to herein as heterogeneous fibers.

These heterogeneous fibers can have a surface exhibiting a relatively lower melt viscosity, and at least one inner region with a higher melt viscosity than the indicated surface. In a preferred embodiment, this at least one higher melt viscosity inner region is, or consists of, or consists essentially of, or consists substantially of, a single higher melt viscosity inner region.

Also as a matter of preference, the melt viscosity of these second fibers is lowest at the surface; accordingly, surface melt viscosity will be lower than the melt viscosity of any portion of the fiber interior. As a matter of particular preference, the melt viscosity increases, from the surface toward the fiber center.

In this regard, it is noted that heterogeneous fibers characterized by a gradient melt viscosity are accordingly preferred as second fibers of the invention. Consistent with the foregoing, particularly preferred such gradient melt viscosity fibers are those wherein the melt viscosity is at its lowest point at the fiber surface, and increases inward toward the center of the fiber.

In a first preferred embodiment, the second fibers of the invention comprise, or consist substantially of, or consist essentially of, or consist of a single polymer or polymer alloy, and have a constant, or essentially constant, or substantially constant melting point across their cross-sections.

In a second preferred embodiment, the melt flow rate of the surface of the second fibers of the invention is at least one third or about one third of the melt flow rate of the first fibers. If melt viscosity is defined by melt flow rate, or melt index, then melt viscosity is inversely proportional to melt flow rate, or melt index; accordingly, for this second preferred embodiment, the melt viscosity of the surface of the second fibers is correspondingly not more than three times or about three times the melt viscosity of the first fibers.

Second fibers of the invention characterized by the indicated consistency of polymer or polymer alloy and consistency of melting point can be considered as examples of the first preferred embodiment, and second fibers of the invention characterized by the indicated melt flow rate/melt viscosity relationship can be considered as examples of the second preferred embodiment. Second fibers of the invention characterized by the features of both embodiments can be considered as examples of either or both embodiments. The features of both embodiments are preferred; correspondingly, the second fibers of the invention are preferably indeed characterized by the indicated features of both embodiments.

Further regarding the indicated first and second preferred embodiments of the heterogeneous fibers of the invention, it is noted that melting point is generally not dependent on polymer molecular weight (e.g., chain length), but is rather a function of the identity of the polymer at issue—or in the case of a polymer alloy, is a function of both the identities and proportions of the polymers making up the alloy. Accordingly, where the fiber is made up of a single polymer or a single polymer alloy, the melting point will be correspondingly constant, regardless of molecular weight variations—e.g., across the fiber cross-section; for instance, if the heterogeneous fiber is prepared from polypropylene alone, then the melting point will be at least substantially constant or even at least essentially constant across the cross-section, regardless of whether there is variation in the length of the polypropylene chains.

However, melt flow rate (and accordingly, melt viscosity) are dependent on polymer molecular weight; specifically, for a particular polymer or polymer alloy, melt flow rate decreases (and melt viscosity increases) as polymer molecular weight increases. Accordingly, with polypropylene again taken as the example, differentiation of chain length across the fiber cross-section entails variation in melt flow rate, though not (as previously discussed) in melting point.

With respect to the foregoing, monocomponent fibers, by virtue of being characterized by a single component, are suitable examples of the first preferred embodiment of the second fibers of the invention—where, of course, they are also characterized by the requisite nonuniform melt viscosity across their cross-sections. If they are further characterized by the indicated melt flow rate/melt viscosity relationship, they are likewise suitable examples of the second preferred embodiment of the second fibers of the invention.

Monocomponent fibers which are appropriate as heterogeneous fibers of the invention include those with thermally oxidized surfaces—i.e., having surface oxidized rheology, whereby the molecular weight and melt viscosity, of the surface regions of these fibers, has been lowered by thermal oxidation. These thermally oxidized surface monocomponent fibers are generally characterized by a gradient melt viscosity; particularly, the melt viscosity is at its lowest point at the fiber surface, and increases toward the center of the fiber.

The indicated lower melt viscosity of the second fiber surface regions, particularly for these monocomponent fibers with thermally oxidized surfaces, can be exhibited by the differential staining which results from the $RuO_4$ staining technique disclosed in Trent et al., in "Ruthenium Tetroxide Staining of Polymers for Electron Microscopy", *Macromolecules,* Vol. 16, No. 4, 1983, and in U.S. application Ser. No. 080,849, filed Jun. 24, 1993; this publication and application are incorporated herein in their entireties, by reference thereto.

With the application of this staining technique to the indicated heterogeneous fiber, the lower melt viscosity regions demonstrate a darker stain than the higher melt viscosity regions. Accordingly, the indicated surface regions, of the second fibers of the invention, are stained darker than the fiber interior regions.

Additionally as to monocomponent fibers which are suitable examples of the second fibers of the invention, such fibers include those for which surface modification is effected by the application of heat, at a location at or adjacent the spinnerette used to produce the fibers; this treatment can provide heterogeneous monocomponent fibers with thermally oxidized surfaces, as discussed herein. One means for providing the requisite heat is with a heated plate, employed in association with the spinnerette. The fiber resulting from this technique is characterized by a skin-core filamentary structure, with the indicated skin having the lower melt viscosity.

Multicomponent fibers, such as bicomponent fibers, are also appropriate as second fibers of the invention. For multicomponent second fibers of the invention, the requisite heterogeneity of melt viscosity is provided by the presence of at least two components having different melt viscosities; as a matter of preference, each component has a different melt viscosity.

Preferred multicomponent second fibers of the invention are those characterized by the sheath/core configuration—i.e., having a core, with one or more concentric outer layers. As a matter of particular preference in this configuration, the outermost concentric layer has the lowest melt viscosity, with melt viscosity increasing inward for each layer toward the core, and the core having the highest melt viscosity.

Particularly as to the first preferred embodiment of the second fibers of the invention, multicomponent fibers suitable for this embodiment are those wherein all the fiber components comprise, or consist essentially of, or consist of the same polymer or polymer alloy, and correspondingly have the same, or essentially the same, or substantially the same melting points. Where it is a polymer alloy which is employed, it is both the identities and the proportions of the polymers in the alloy which will be the same—or substantially the same, or essentially the same—for each component, in addition to all the components being characterized by the indicated consistency of melting point. Particularly where all the components are of the same polymer—e.g., where all the components are polypropylene—the nonuniformity of melt flow rate across the fiber cross-section will be provided by differences in molecular weight between components.

Regarding the second preferred embodiment of the second fibers of the invention, multicomponent fibers suitable for this embodiment are those wherein the outermost concentric layer has a melt flow rate at least one third or about one third of the melt flow rate of the first fibers—and correspondingly, a melt viscosity not more than three times or about three times the melt viscosity of the first fibers. For this second preferred embodiment, the consistencies of polymer or polymer alloy and melting point which characterize the first preferred embodiment are preferred, as indicated, but are not required.

Accordingly, in multicomponent fibers of this second preferred embodiment, there can be components which comprise different polymers and/or polymer alloys. Consistent with the foregoing, differences between polymer alloys can be in the form of the polymer identities and/or proportions; in this regard, two particular components may comprise alloys of the same polymers, with the alloys of these two components still being considered different because of the difference between their respective proportions of these polymers. Further as to multicomponent fibers of this second preferred embodiment, the thusly different polymers and/or polymer alloys preferably also have different melting points; however, their melting points can also be the same, or substantially the same, or essentially the same.

Fibers disclosed in the indicated U.S. application Ser. No. 080,849, filed Jun. 24, 1993, are suitable as second fibers of the invention. Moreover, fibers disclosed in European Patent Application 0 445 536, in U.S. Pat. No. 5,281,378, and in U.S. application Ser. No. 145,360, filed Oct. 29, 1993, U.S. application Ser. No. 003,696, filed Jan. 13, 1993, U.S. application Ser. No. 474,897, filed Feb. 5, 1990, U.S. application Ser. No. 683,635, filed Apr. 11, 1991, U.S. application Ser. No. 836,438, filed Feb. 18, 1992, and U.S. application Ser. No. 939,857, filed Sep. 2, 1992, are suitable as second fibers of the invention; these patent publications, and these applications, are incorporated herein in their entireties, by reference thereto. Yet further, the fiber preparation processes disclosed in the foregoing applications and publications are correspondingly suitable for preparing second fibers of the invention.

Commercially available fibers with thermally oxidized surfaces and gradient melt viscosities, and which are appropriate as second fibers of the invention, include T-190™, T-196™, and T-211 polypropylene fibers, from Hercules Incorporated, Wilmington, Del. Of these, the T-190™ and T-211 fibers are hydrophobic, having been treated with a hydrophobic finish; the T-196™ fibers are hydrophilic, having been treated with a hydrophilic finish. The surface regions of these fibers have low molecular weight and low melt viscosity.

The second fibers of the invention generally have a decitex (decitex, or dtex, being defined as the weight in grams of a 10,000 meter length of the fiber) of about 0.5–6. Two forms in which the second fibers may be provided are as cardable staple fibers—preferably, in typical cut lengths, of about 2 to 10 centimeters—or as spunbonded continuous filaments. Such staple fibers, and spunbonded continuous filaments, are obtainable by conventional procedures.

Further as to melt flow rate/melt viscosity relationship, it is preferred—particularly for the second preferred embodiment of the second fibers of the invention—that the second fibers' surfaces have a melt viscosity—and accordingly, also preferably, a melt flow rate—generally similar to that of the first fibers. In this context, generally similar means that the melt viscosity or melt flow rate of one is not more than about three times that of the other.

Generally with respect to melt flow rate, the appropriate test procedures and conditions should be employed for measuring this parameter. One factor to consider is whether it is the meltblown microfibers or the heterogeneous fibers (particularly their surfaces) for which the melt flow rate is being measured; another factor is the identity of the polymer for which the measurement is taken. It is noted that, for the particular fibers and polymers employed, those of ordinary skill in the art can readily determine the appropriate test procedures and conditions for measuring melt flow rate.

For commercially available polypropylene meltblown microfibers, ASTM D1238L-82, Condition FR-230/2.16—which is incorporated herein in its entirety, by reference thereto—is appropriate for measuring melt flow rate. These fibers, measured by the foregoing ASTM procedure, generally have a melt flow rate of about 800 to 1200 decigrams/minute.

As a practical matter, this ASTM procedure is not preferred for measuring the melt flow rate of the surfaces of the second fibers of the invention—because of the difficulty of separating the surface region from the rest of the fiber. However, the decigrams/minute melt flow rate of the second fiber surfaces may be determined by conversion from the Intrinsic Viscosity (IV) value, as set forth hereinafter.

Specifically, the Intrinsic Viscosity value of the second fiber surface polymer is measured according to ASTM D 2857-70 (Reappproved 1977), which is incorporated herein in its entirety, by reference thereto; where the polymer is polypropylene, the solvent employed is decahydronaphthalene (Decalin), with the test temperature being 135° C. The Intrinsic Viscosity value obtained from this procedure is then converted to the melt flow rate (MFR) by means of the appropriate formula; for polypropylene, the formula is $MFR=327/(IV)^5$.

With polypropylene first fibers in the 800 to 1200 decigrams/minute melt flow rate range as indicated above, the melt flow rate of the polypropylene surfaces of the second fibers—considering that the melt flow rate/melt viscosity relationship which characterizes the second preferred embodiment of the second fibers is a preferred feature—should correspondingly be about 265 to 400 decigrams/minute, or at least about 265 decigrams/minute (i.e., an Intrinsic Viscosity of less than about 1.04), and more preferably at least about 800 decigrams/minute—measured by conversion from the Intrinsic Viscosity value, according to the previously indicated procedure.

The T-190™, T-196™, and T-211 fibers—as discussed, characterized by thermally oxidized surfaces and gradient melt viscosities—typically have a surface melt flow rate of at least about 1000 decigrams/minute, measured by conversion from the Intrinsic Viscosity value. Accordingly, these fibers are particularly suitable for use with the commercially available 800–1200 decigrams/minute melt flow rate polypropylene meltblown microfibers.

This relationship of melt flow rate, or melt viscosity, beneficially affects the thermal bonding which is achieved between the indicated first and second fibers. Specifically, meltblown microfibers are typically characterized by a high melt flow rate. Where the melt flow rate of the second fibers' surfaces is correspondingly sufficiently high, the resulting polymer flow, under the requisite bonding conditions, accordingly provides intimate thermal bonding between the first and second fibers, and also favorable consolidation, in the textile structure of the invention.

It is also preferred that the first fibers and the surfaces of the second fibers comprise at least similar, or even closely similar, and, particularly preferably identical, or at least substantially identical polymers—e.g., in molecular weight, chemical composition, etc. Yet additionally as a matter of particular preference, the polymers of the first fibers and the surfaces of the second fibers both comprise polyolefin—most preferably, polypropylene.

This similarity of polymers is also a factor affecting the bonding between the first and second fibers. As discussed with respect to the melt flow rate relationship, closer similarity, or at least a sufficient similarity, likewise improves this bonding; for instance, this effect is realized where both the first and second fiber surfaces comprise polypropylene.

The first fibers and the second fibers (particularly their surfaces) of the invention can be hydrophobic or hydrophilic. Any combination of hydrophobicity and hydrophilicity suitable for the intended purpose can be employed. For instance, both the first fibers and the second fibers can be hydrophobic or hydrophilic, or one can be hydrophobic and the other hydrophilic, or one or both can be part hydrophobic and part hydrophilic; where the first and/or the second fibers thusly include a portion of hydrophobic fibers and a portion of hydrophilic fibers, the ratio of hydrophobic fibers to hydrophilic fibers is appropriate for the intended purpose.

Preferably, both the first fibers and the second fibers are hydrophobic, or both are hydrophilic; most preferably, both are hydrophobic. Hydrophobicity and hydrophilicity can be obtained by inclusion of suitable additives in preparation of the fibers, or by application of appropriate finishes to the fibers, or to the fiber webs or layers, or to the fabrics themselves.

The first and second fibers are preferably provided, to the textile structure of the invention, in the form of webs, or layers. Specifically, the textile structures of the invention are preferably composite laminate nonwoven structures or fabrics, with each of the first fibers, and the second fibers, provided as layers forming the structure—i.e., at least one layer of the first fibers, and at least one layer of the second fibers, being positioned in surface to surface relationship; as a matter of particular preference, the one or more first fiber layers and one or more second fiber layers are configured in alternating relationship.

In a preferred embodiment, the composite nonwoven structure of the invention has one meltblown microfiber layer, and one heterogeneous fiber layer. Another preferred embodiment incorporates a meltblown microfiber layer between two heterogeneous fiber layers.

In the composite nonwoven structures of the invention, the ratio, of the basis weight of the at least one layer of the first fibers, to the basis weight of the at least one layer of the second fibers, is preferably from about 1:0.5 to about 1:10, and more preferably from about 1:1 to about 1:6. As a matter of particular preference, this ratio is from about 1:2 to about 1:4.

Also in the composite nonwoven structures of the invention, preferably, each at least one layer of the first fibers has a basis weight of about 5–25 g/m$^2$ and each at least one layer of the second fibers has a basis weight of about 5–100 g/m$^2$; more preferably, each at least one layer of the first fibers has a basis weight of about 8–20 g/m$^2$ and each at least one layer of the second fibers has a basis weight of about 10–65 g/m$^2$. As a matter of particular preference, each at least one layer of the first fibers has a basis weight of about 8–15 g/m$^2$ and each at least one layer of the second fibers has a basis weight of about 20–50 g/m$^2$.

The composite nonwoven structures themselves preferably have a basis weight of about 10–125 g/m$^2$; more preferably, about 18–85 g/m$^2$. As a matter of particular preference, the basis weight, of the composite nonwoven structures of the invention, is about 28–65 g/m$^2$.

For preparing composite nonwoven structures of the invention, meltblown microfiber webs can be provided, as discussed, for the one or more first fiber layers. Where the second fibers are in the form of cardable staple fibers, second fiber webs can be provided by carding the cardable staple fibers; for second fibers in the form of spunbonded continuous filaments, webs can be produced by conventional spunbonding processes.

Composite nonwoven structures of the invention can be provided by thermal bonding—with the requisite application of heat and pressure, to effect consolidation of surface-to surface positioned first and second fiber webs; suitable thermal bonding techniques include calender, through-air, and ultrasonic bonding, with calender bonding being preferred. For these first and second fiber webs, employment of polymers characterized by the discussed melt flow rate relationship beneficially affects the consolidation between of the composite nonwoven structure of the invention—as does the indicated use of similar, or preferably at least substantially identical polymers.

Where the second fibers of the invention are cardable staple fibers, the indicated consolidation can be accomplished in one step, together with the carding process for preparing the second fiber web; as one means for accomplishing this result, two separate webs of staple fiber can be prepared initially, by separate carding procedures, then combined into a single web—the thusly combined web then being subjected to the thermal bonding step, with a meltblown microfiber web. Alternatively, the second fiber layer can be prepared by a process of both carding and thermal bonding, prior to consolidation with the first fiber web; in this instance, a separate thermal bonding process is employed to effect the consolidation.

Correspondingly, where the second fibers of the invention are spunbonded continuous fibers, consolidation of the first and second fibers can be accomplished in combination with the spunbonding process, or in a separate step.

Figure 2:
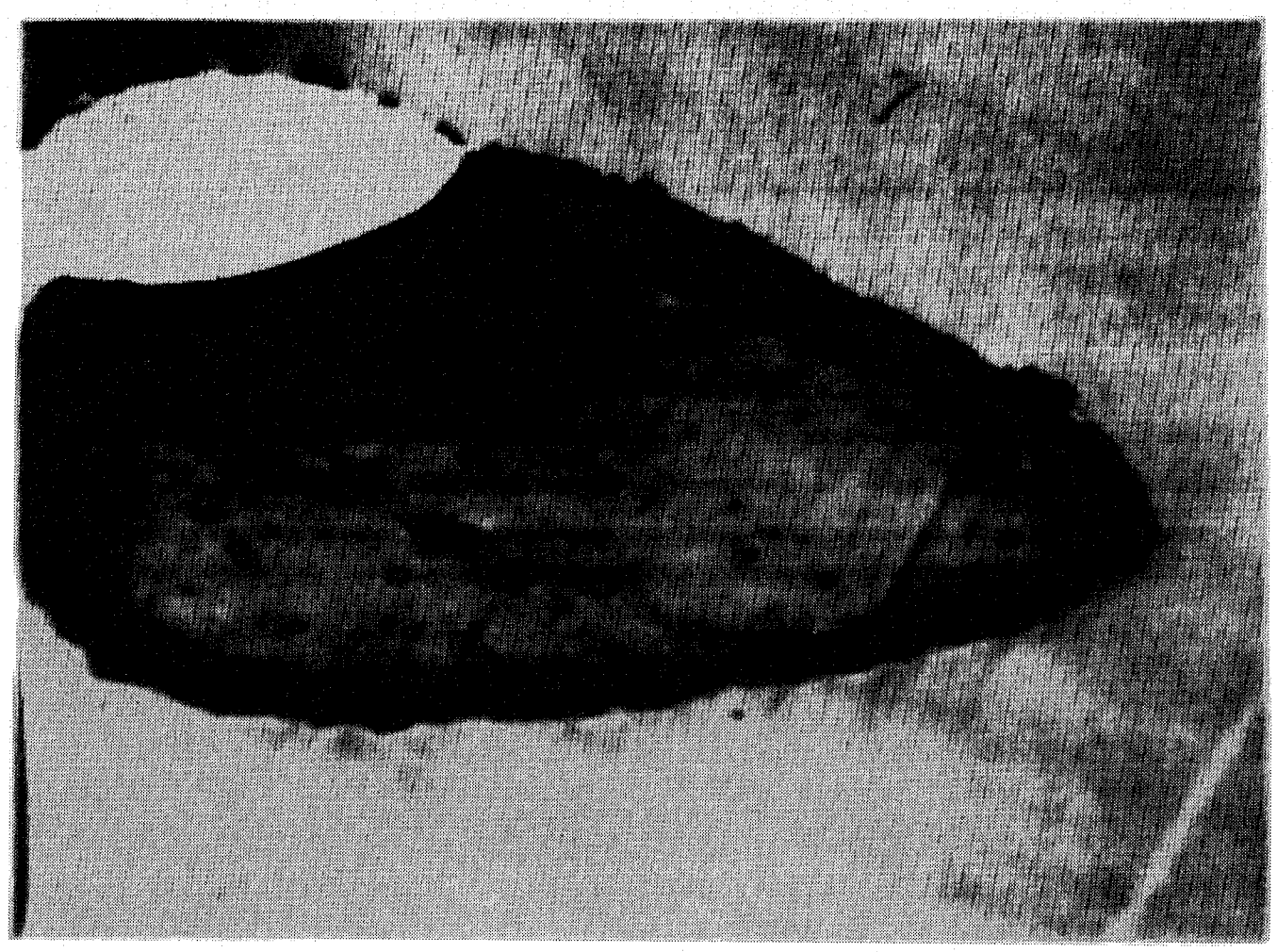

Identification of difference in melt flow rate, or melt viscosity, in the second fibers of the invention, by the differential staining resulting from use of the $RuO_4$ staining technique, is demonstrated in FIGS. 1 and 2. FIG. 1 is a transmission electron photomicrograph of a cross-section of a T-196™ polypropylene staple fiber, at about 5000× magnification; FIG. 2 is a transmission electron photomicrograph of a cross-section of a T-211 polypropylene staple fiber, also at about 5000× magnification.

As is shown in both FIGS. 1 and 2, the darker area indicates the higher melt flow rate region of the fiber. Accordingly, the dark surface ring indicates that the surface region is the lower melt viscosity region.

Figure 3:
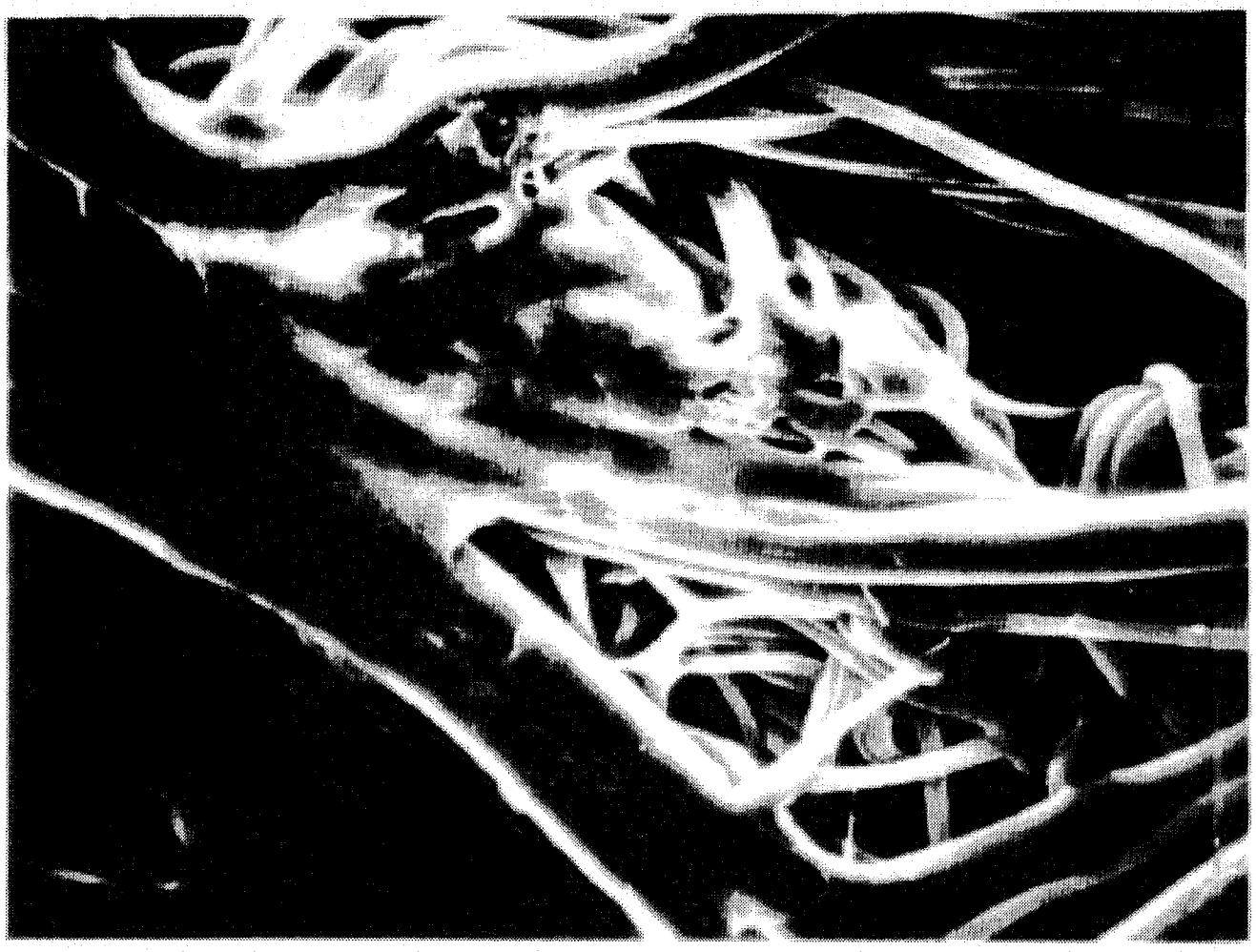
FIG. 3 is a scanning electron photomicrograph of a composite nonwoven fabric of the invention, at about 760× magnification.

FIG. 3 is a scanning electron photomicrograph, at about 760× magnification, of a composite nonwoven structure of the invention, prepared from calender bonding of a polypropylene meltblown microfiber layer, provided by a web obtained from Ergon Nonwovens, Inc., and a heterogeneous fiber layer, prepared from T-211 polypropylene staple fibers. The heterogeneous fibers are the larger fibers, and the meltblown microfibers are the smaller fibers; in this photomicrograph, there is shown the considerable flow of polymer—between the lower melt viscosity heterogeneous fiber surface polymer, and the meltblown microfibers—and the corresponding significant degree of bonding which results.

Figure 4:
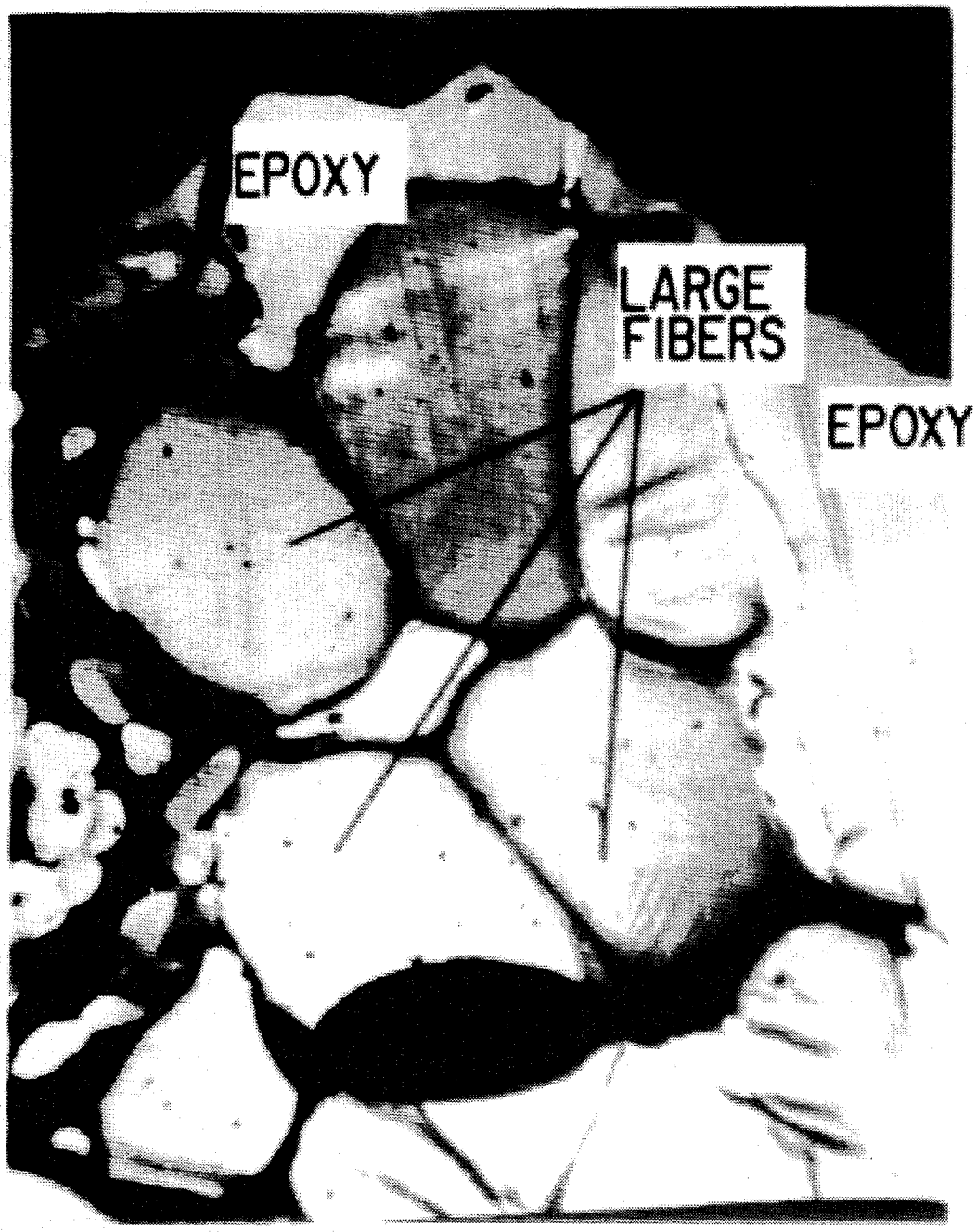
FIG. 4 is a transmission electron photomicrograph of a cross-section of the composite nonwoven fabric of FIG. 3, at about 2200× magnification. As with the fibers in FIGS. 1 and 2, the fabric here is stained by the $RuO_4$ staining technique.

FIG. 4 is a transmission electron photomicrograph of a cross-section of the same fabric as FIG. 3, at about 2200× magnification. This fabric has also been subjected to the $RuO_4$ staining technique as employed with the fibers of FIGS. 1 and 2.

This photomicrograph shows a portion of the fabric cross-section which includes the interface between the heterogeneous and the meltblown microfiber layers; the indicated heterogeneous fibers are identified in the photomicrograph as the large fibers, while the microfibers are designated therein by the letter S. The epoxy used to hold the fabric cross-section together, to enable the photomicrograph to be taken, is also identified.

Additionally in this photomicrograph, the dark areas therein are designated with the letter D. Consistent with FIGS. 1 and 2, they indicate the regions of polymer characterized by high melt flow rate, or low melt viscosity.

The positioning of these areas demonstrates the favorable consolidation achieved, in the composite nonwoven structure of the invention. As one aspect, the dark rings surrounding the heterogeneous fibers confirms their nonuniform melt viscosity configuration; further, the pronounced dark area, at the interface between the first and second fiber layers—consistent with what is shown in FIG. 3, as discussed—demonstrates the high degree of polymer flow, between the heterogeneous fiber surface regions and the meltblown microfibers, as indicative of the improved bonding which is achieved.

Textile structures of the invention, particularly the composite nonwoven structures, are useful in both hydrophilic and hydrophobic applications, with the latter being preferred. In particularly preferred hydrophobic applications, the textile structures of the invention serve as barrier fabrics.

In this regard, the composite fabrics are useful as in a variety of medical fabrics applications, such as sterilization wraps for surgical instruments and other health care supplies—e.g., sterile gloves, syringes, and surgical packs. They are also suitable for barrier protective garments, including surgical caps, gowns, scrub apparel, and isolation gowns, as well as surgical table and Mayo stand covers, industrial garments and fabrics, etc. Yet additionally, they are suitable as the barrier fabric components for hygiene products, e.g., as barrier cuffs for waste containment articles such as diapers.

A suitable hydrophilic application for the textile structures of the invention is filtration.

The invention is illustrated by the following Experimental Procedure, which is provided for the purpose of representation, and is not to be construed as limiting the scope of the invention. Unless stated otherwise, all percentages, parts, etc. are by weight.

EXPERIMENTAL PROCEDURE

Composite nonwoven fabrics A–L, of the following Tables, are fabrics of the present invention, and were prepared in the manner discussed below.

T-211, T-190™, and T-196™ polypropylene staple fibers, having a fineness of dtex as set forth in Table 1, were carded into webs. Two carding machines were used for this purpose, operated at line speeds as also indicated in Table 1. The webs from the two carding machines were combined into a single web, having a basis weight as noted in Table 1 under the heading "Carded Web Weight".

The resulting single carded web was combined with a polypropylene meltblown microfiber web, obtained from Ergon Nonwovens, Inc. This meltblown microfiber web had a basis weight of 16 g/m$^2$ and a melt flow rate of 900 decigrams/minute, ±15% (i.e., ±135 decigrams/minute), measured according to ASTM D1238L-82, Condition FR-230/2.16.

The carded web and the meltblown microfiber web were fed together to thermal bonding steel calender rolls, with the two webs coming together just prior to the rolls' nip—the result having a total fabric weight, as set forth in Table 1.

The top calender roll had diamond shaped bond points, with a total bonding area of about 15–20% while the bottom calender roll had a smooth surface. The calender rolls were operated at a roll pressure of 43 kg per linear centimeter, and at speeds and temperatures as indicated in Table 1.

Fabric M, a control, was the indicated meltblown microfiber web by itself, in the form as obtained from the supplier.

Fabric N was another control, prepared from the indicated T-211 polypropylene staple fiber, without meltblown microfiber. In the preparation of this fabric, there was accordingly no coming together with meltblown fiber, as discussed with respect to the process for obtaining fabrics A–L. Otherwise, Fabric N was prepared in the manner as noted above for these composite nonwoven fabrics.

TABLE 1

| Fabric No. | Stable Fiber Type | dtex | Carded Web Weight g/m$^2$ | Total Fabric Weight g/m$^2$ | Speed m/min | Top/Bottom Roll Temp °C./°C. |
|---|---|---|---|---|---|---|
| A | T-211 | 1.7 | 37 | 53 | 15 | 140/140 |
| B | T-211 | 0.8 | 24 | 40 | 15 | 150/150 |
| C | T-211 | 1.7 | 24 | 40 | 15 | 140/140 |
| D | T-211 | 1.7 | 41 | 57 | 15 | 140/140 |
| E | T-211 | 1.7 | 52 | 68 | 15 | 140/140 |
| F | T-211 | 1.7 | 42 | 58 | 15 | 140/140 |
| G | T-211 | 1.7 | 34 | 50 | 30 | 140/140 |
| H | T-211 | 1.7 | 33 | 49 | 30 | 140/140 |
| J | T-211 | 1.7 | 33 | 49 | 45 | 140/140 |
| K | T-190 ™ | 2.4 | 35 | 51 | 15 | 140/145 |
| L | T-196 ™ | 2.4 | 37 | 53 | 15 | 140/140 |
| M | None | — | — | 16 | — | — |
| N | T-211 | 1.7 | 49 | 49 | 30 | 157/157 |

These fabrics were tested for grab strength and elongation according to the IST 110.1-92 G-T test, for air permeability according to the IST 70.1-92 test, and for hydrostatic head according to the IST 80.4-92 test; these three tests are INDA Standard Test Methods, INDA, Association of the Nonwoven Fabrics Industry, Cary, N.C., and are all incorporated herein in their entireties, by reference thereto. The results of these tests are set forth in Table 2 below.

The fabric grab strength and elongation were each measured in both the machine and cross directions, and are set forth in Table 2 under the headings MDT (Machine Direction Tensile Strength), CDT (Cross Direction Tensile Strength), MDE (Machine Direction Elongation), and CDE (Cross Direction Elongation). The grab strength and elongation values are expressed in pounds and as percentages, respectively.

Further as to the results noted in the following Table, the air permeability of the fabrics is expressed as $$\left(\frac{ft^3}{ft^2 \times min}\right).$$

The hydrostatic head is expressed in centimeters of water column height.

TABLE 2

| Fabric No. | Total Wt. g/m² | Grab Strength MDT lbs. | Grab Strength CDT lbs. | Elongation MDE % | Elongation CDE % | Air Perm. $\left(\frac{ft^3}{ft^2 \times min}\right)$ | Hydrostatic Head cm |
|---|---|---|---|---|---|---|---|
| A | 53 | 21.4 | 8.8 | 49 | 52 | 33 | 34 |
| B | 40 | 22.2 | 6.9 | 30 | 41 | 33 | 40 |
| C | 40 | 16.8 | 6.9 | 51 | 49 | 33 | 36 |
| D | 57 | 25.6 | 10.2 | 58 | 55 | 38 | 47 |
| E | 68 | 26.0 | 11.2 | 48 | 50 | 26 | 42 |
| F | 58 | 24.0 | 8.5 | 49 | 58 | 31 | 50 |
| G | 50 | 18.5 | 6.9 | 44 | 53 | 36 | 60 |
| H | 49 | 19.6 | 7.3 | 49 | 44 | 33 | 60 |
| J | 49 | 10.1 | 5.1 | 30 | 31 | 43 | 38 |
| K | 51 | 11.2 | 5.5 | 30 | 27 | 30 | 37 |
| L | 53 | 13.6 | 6.4 | 29 | 35 | 30 | 16 |
| M | 16 | 3.3 | 3.0 | 27 | 35 | 106 | 23 |
| N | 49 | 26.5 | 9.6 | 60 | 121 | 205 | 21 |

The results shown in Table 2 demonstrate the excellent barrier properties of the fabrics of the invention. Particularly evident is the low air flow rate of the composite Fabrics A–L of the invention—especially in comparison both with Fabric M, which was the meltblown microfiber fabric alone, and with Fabric N, correspondingly prepared from the heterogeneous fiber alone. As to the indicated Fabric N, it is noted that each of the composite fabrics is characterized by an air flow rate many times lower than that of this control, even though its fabric weight is within their range.

Finally, although the invention has been described with reference to particular means, materials, and embodiments, it should be noted that the invention is not limited to the particulars disclosed, and extends to all equivalents within the scope of the claims.

What is claimed is:

1. A nonwoven structure comprising first fibers and second fibers:

the first fibers comprising meltblown microfibers; and the second fibers consisting essentially of a single polymer or polymer alloy, and having nonuniform melt viscosity and a substantially constant melting point across their cross-sections.

2. The nonwoven structure of claim 1, comprising a composite nonwoven structure, the composite nonwoven structure comprising at least one layer of the first fibers and at least one layer of the second fibers.

3. The composite nonwoven structure of claim 2, wherein the at least one layer of the first fibers and the at least one layer of the second fibers are positioned in alternating surface to surface relationship.

4. The composite nonwoven structure of claim 3, wherein the second fibers comprise a member selected from the group consisting of:

monocomponent fibers comprising thermally oxidized surfaces; and multicomponent fibers comprising a core and at least one concentric layer.

5. The composite nonwoven structure of claim 4, wherein the second fibers are differentially stainable by $RuO_4$, the surface of the second fibers demonstrating a darker stain than interior regions of the second fibers.

6. The composite nonwoven structure of claim 5, wherein the second fibers are monocomponent fibers comprising thermally oxidized surfaces.

7. The composite nonwoven structure of claim 4, wherein the melt flow rate, of the surface of the second fibers, is at least about one third of the melt flow rate of the first fibers.

8. The composite nonwoven structure of claim 7, wherein the first fibers comprise a first polymer and the second fibers consist essentially of a second polymer, the first polymer and the second polymer being selected from the group consisting of similar polymers, and substantially identical polymers.

9. The composite nonwoven structure of claim 8, wherein the first fibers and the second fibers are hydrophobic.

10. The composite nonwoven structure of claim 8, wherein each of the first polymer and the second polymer is a polyolefin.

11. The composite nonwoven structure of claim 10, wherein the polyolefin is polypropylene.

12. The composite nonwoven structure of claim 11, wherein the melt flow rate of the first fibers is about 800–1200 decigrams/minute, measured according to ASTM D1238L-82, Condition FR-230/2.16, and the melt flow rate, of the surface of the second fibers, is at least about 265 decigrams/minute, measured by conversion from the Intrinsic Viscosity value.

13. The composite nonwoven structure of claim 12, wherein the melt flow rate, of the surface of the second fibers, is at least about 800 decigrams/minute, measured by conversion from the Intrinsic Viscosity value.

14. A nonwoven structure comprising first fibers and second fibers:

the first fibers comprising meltblown microfibers; and the second fibers having nonuniform melt viscosity across their cross-sections;

wherein the melt flow rate, of the surface of the second fibers, is at least about one third of the melt flow rate of the first fibers.

15. The nonwoven structure of claim 14, comprising a composite nonwoven structure, the composite nonwoven structure comprising at least one layer of the first fibers and at least one layer of the second fibers.

16. The composite nonwoven structure of claim 15, wherein the at least one layer of the first fibers and the at least one layer of the second fibers are positioned in alternating surface to surface relationship.

17. The composite nonwoven structure of claim 16, wherein the second fibers comprise multicomponent fibers comprising a core and at least one concentric layer.

18. The composite nonwoven structure of claim 16, wherein the first fibers comprise a first polymer and the surface of the second fibers comprise a second polymer, the first polymer and the second polymer being selected from the group consisting of similar polymers, and substantially identical polymers.

19. The composite nonwoven structure of claim 18, wherein the first fibers and the surface of the second fibers are hydrophobic.

20. The composite nonwoven structure of claim 18, wherein the first fibers and the surface of the second fibers comprise polyolefin.

21. The composite nonwoven structure of claim 20, wherein the polyolefin comprises polypropylene.

22. The composite nonwoven structure of claim 21, wherein the melt flow rate of the first fibers is about 800–1200 decigrams/minute, measured according to ASTM D1238L-82, Condition FR-230/2.16, and the melt flow rate, of the surface of the second fibers, is at least about 265 decigrams/minute, measured by conversion from the Intrinsic Viscosity value.

23. The composite nonwoven structure of claim 22, wherein the melt flow rate, of the surface of the second fibers, is at least about 800 decigrams/minute, measured by conversion from the Intrinsic Viscosity value.

24. A method of preparing a composite nonwoven structure, comprising at least one layer of first fibers and at least one layer of second fibers, the first fibers comprising meltblown microfibers; and the second fibers consisting essentially of a single polymer or polymer alloy, and having nonuniform melt viscosity and a substantially constant melting point across their cross-sections;

the method comprising a bonding step, of thermally bonding the at least one layer of first fibers and the at least one layer of second fibers to one another.

25. The method of claim 24, further comprising, prior to the bonding step, a preliminary bonding step, comprising thermally bonding carded staple fibers, to obtain the at least one layer of second fibers.

26. The method of claim 24, wherein the second fibers comprise spunbonded continuous filaments, the method further comprising, prior to the bonding step, preparation of the at least one layer of second fibers.

27. The method of claim 24, wherein the bonding step comprises calender bonding the at least one layer of first fibers and the at least one layer of second fibers.

28. The method of claim 24, wherein the first fibers and second fibers comprise polyolefin fibers.

29. The method of claim 28, wherein the polyolefin comprises polypropylene.

30. The method of claim 29, wherein the second fibers comprise spunbonded continuous filaments, the method further comprising, prior to the bonding step, preparation of the at least one layer of second fibers.

31. A method of preparing a composite nonwoven structure, comprising at least one layer of first fibers and at least one layer of second fibers, the first fibers comprising meltblown microfibers; and the second fibers having nonuniform melt viscosity across their cross-sections, and having surfaces characterized by a melt flow rate which is at least about one third of the melt flow rate of the first fibers;

the method comprising a bonding step, of thermally bonding the at least one layer of first fibers and the at least one layer of second fibers to one another.

32. The method of claim 31, further comprising, prior to the bonding step, a preliminary bonding step, comprising thermally bonding carded staple fibers, to obtain the at least one layer of second fibers.

33. The method of claim 31, wherein the second fibers comprise spunbonded continuous filaments, the method further comprising, prior to the bonding step, preparation of the at least one layer of second fibers.

34. The method of claim 31, wherein the bonding step comprises calender bonding the at least one layer of first fibers and the at least one layer of second fibers.

35. The method of claim 31, wherein the first fibers and second fibers comprise polyolefin fibers.

36. The method of claim 35, wherein the polyolefin comprises polypropylene.

37. The method of claim 36, wherein the second fibers comprise spunbonded continuous filaments, the method further comprising, prior to the bonding step, preparation of the at least one layer of second fibers.

* * * * *